United States Patent [19]

Bouwknegt et al.

[11] 4,374,340

[45] Feb. 15, 1983

[54] LOW PRESSURE DISCHARGE LAMP

[75] Inventors: Albert Bouwknegt; Petrus C. Lauwerijssen, both of Roosendaal, Netherlands

[73] Assignee: U.S. Philips Corporation, New York, N.Y.

[21] Appl. No.: 130,930

[22] Filed: Mar. 17, 1980

[30] Foreign Application Priority Data

Apr. 3, 1979 [NL] Netherlands ..... 7902572

[51] Int. Cl.[3] ..... H01J 17/16; H01J 61/30; H01J 17/18

[52] U.S. Cl. ..... 313/220; 313/204; 313/227

[58] Field of Search ..... 313/204, 220, 493, 223–229

[56] References Cited

U.S. PATENT DOCUMENTS 1,946,726 2/1934 Barclay ..... 313/204 X
2,185,674 1/1940 Michel ..... 313/204 X

*Primary Examiner*—Marvin L. Nussbaum
*Attorney, Agent, or Firm*—Robert S. Smith

[57] ABSTRACT

Low-pressure gas discharge lamp having a discharge vessel which comprises a plurality of parallel tubular portions which are interconnected in series by means of one or more coupling links engaging those portions substantially transversely, the discharge passing through the coupling link(s) and at least the major parts of the tubular portions during operation of the lamp, a coupling link engaging a tubular portion at a distance from one end of a tubular portion so that a cool spot is created in the lamp at that end.

4 Claims, 3 Drawing Figures

LOW PRESSURE DISCHARGE LAMP

Figure 1:
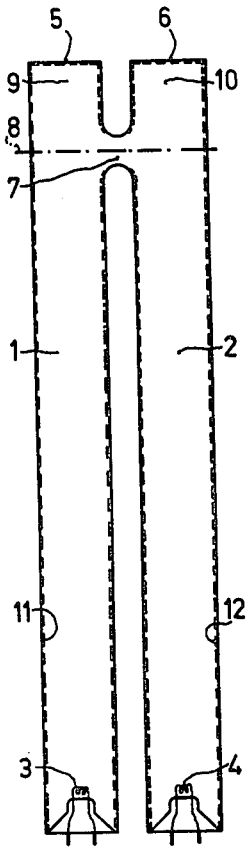

The invention relates to a low-pressure mercury vapor discharge lamp having a discharge vessel comprising a plurality of parallel coextensive tubular portions which are interconnected in series to form a continuous passage therethrough by means of one or more coupling tubes, the axis of the or each coupling tube extending substantially transversely to the parallel axes of the tubular portions, the discharge passing through the coupling tube(s) and at least the major part of each tubular portion, during operation of the lamp. Such a lamp is disclosed in German Patent Specification No. 858,105.

This Patent Specification proposes, for some specific uses, to replace the known elongate tubular low-pressure mercury vapor discharge lamp having a length of 120 cm and an inside diameter of 30 to 40 mm by two parallel tubes having the same inside diameter and the same overall length (each being approximately 60 cm long), the discharge spaces limited by those tubes are interconnected by means of a coupling tube located at one end, of the discharge tubes, the electrodes are provided at the other ends of the discharge tubes so that during operation of the lamp a U-shaped discharge path is present. A discharge vessel having such a shape has the advantage that a U-shaped discharge path is obtained without the necessity of bending the elongate cylindrical discharge vessel. When producing U-shaped tubular discharge vessels of low-pressure mercury vapor discharge lamps from a straight tube by bending, a luminescent layer is usually applied to the inside of the discharge vessel wall prior to bending. The presence of luminescent layers complicates the bending process as additional precautions must be taken to protect the luminescent layer from damage during bonding. A further drawback of bending the above-mentioned elongate tubes to form a "U" is that the minimum obtainable radius of curvature of the bent portion is limited. On the other hand, coating an already bent discharge tube, with luminescent material is time-consuming and complicated.

As examples of suitable uses of the relatively large lamps having a shape as defined in the opening paragraph hereof, the German Patent Specification mentions the use as a standard lamp, a desk lamp (possibly provided with a suitable lamp shade), and hanging lamp.

It is possible to reduce the size at the discharge vessel of low-pressure mercury vapor discharge lamps by reducing its length and diameter (see United Kingdom patent application No. 7,833,805, Ser. No. 2,003,315A). By interconnecting such small tubular discharge vessels in series by means of coupling tubes in a manner described in the above-mentioned German Patent Specification, it is possible to obtain lamps which are sufficiently small to serve as an alternative for incandescent lamps for general illumination purposes. However, there is a risk that, owing to the relatively small volume in which the discharge is present, the temperature in the discharge vessel may increase to such a value at a given applied power that the critical mercury vapor pressure for optimum conversion of electric power into ultraviolet radiation is exceeded. The efficiency of the lamp then decreases. To control the mercury vapor pressure in such a discharge vessel additional measures are then often required, for example the provision of cooling shields near the electrodes or the provision of a mercury amalgam in the discharge vessel. These measures result in a complicated production method, particularly for relatively small lamps.

It is an object of the invention to provide a lamp wherein the discharge path is folded by means of a relatively simple construction, the abovementioned means for controlling the mercury vapor pressure in the discharge vessel then not being required.

According to the invention, a lamp of the type mentioned in the opening paragraph is characterized in that at least one coupling tube engages the wall of an associated tubular portion with its axis at a distance from the nearer end of that tubular portion of one to four times the inner diameter of the tubular portion.

With a lamp according to the invention the distance from the axis of the coupling tube to the end of the tubular portion is much greater than with a lamp according to the above-mentioned German Patent Specification in which the coupling between the two tubes is located substantially at the extreme ends of the tubes remote from the electrodes. A relatively cool region has been created near the end of the discharge tube in a discharge vessel of a lamp according to the invention. In that region the influence of the heat from the discharge during operation is relatively small and the cooling action is great, owing to the relatively large wall surface in that region. In a lamp according to the invention, the above-mentioned distance range has been chosen so that, during operation, the mercury condensed in the cool spot has such a temperature that the mercury vapor pressure in the whole discharge vessel is near the optimum value for the conversion of electric power into ultraviolet radiation. However, the length of the discharge path is still amply sufficient to provide a lamp having a high luminous flux and an advantageous efficiency. If the said distance is greater than the said four times the inside diameter of the tubular portion, the appearance from one end of the lamp during operation is not very attractive. In addition, any additional cooling effect obtainable by increasing the distance is small.

Each coupling tube can be formed in several ways. It may, for example, consist of a tube (glass or metal) which is secured in a gas-tight manner to the tubular portions by means of a sealing glass. Preferably each coupling tube comprises two abutting collars each sealed around a respective aperture in the wall of a respective one of two adjacent tubular portions, the collars being sealed together at their abutting portions. In this manner it is possible to realize a discharge vessel whose serially-coupled parallel tubular portions, through which the discharge passes, are located at a very short distance from one another. In view of its small dimensions, it is not necessary with low-pressure mercury vapor discharge lamps to coat the inside of the wall of the cross-coupling tube with a luminescent layer. In addition, the preferred embodiment has the advantage that the tubular portions each complete with its collar can be connected together directly without the necessity for "loose" (discrete) tubular components when forming the coupling tube (such as small pipes).

A lamp according to the invention can be produced in a simple manner. Problems of a glass technological nature, which occur during the production of U-shaped discharge lamps during bending of the discharge vessel, do not arise with lamps according to the invention. Neither is it necessary to take special measures required during the production of U-shaped discharge lamps to improve the adhesion of the luminescent powders in the region of the bent portion in order to reduce the risk of damage thereto.

With lamps according to the invention, wherein the discharge vessel is assembled from three or more coupled tubular portions through which the discharge passes, it is not necessary for these portions to be located in one plane. In one possible use four of these tubular portions are arranged in a square formation, possibly enveloped by an outer bulb.

Low-pressure mercury vapor discharge lamps according to the invention, wherein the inside of the discharge vessel wall is provided with a luminescent layer, and the discharge vessel is formed from two or more tubular portions located in one plane, can serve as an alternative for incandescent lamps, particularly in locations where the bulb shape or the heat generated in incandescent lamps is a drawback, such as in many luminaires for home lighting.

Embodiments of a low-pressure mercury vapor discharge lamp according to the invention will now be described with reference to the accompanying drawing.

Figure 2:
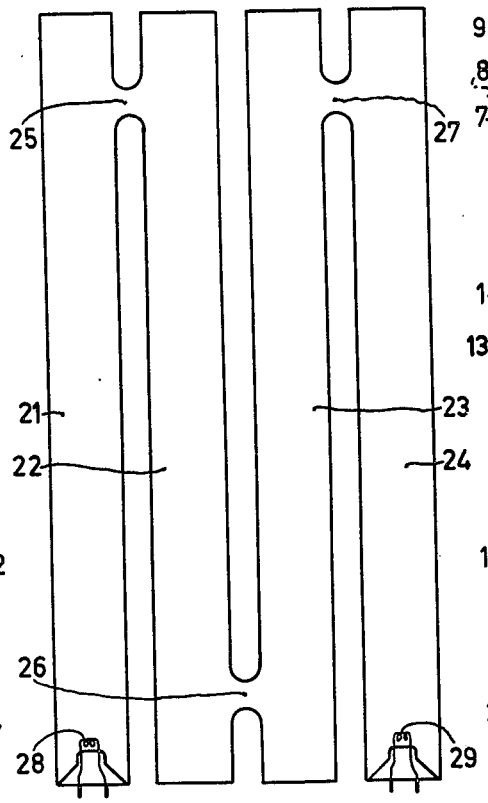
Figure 3:
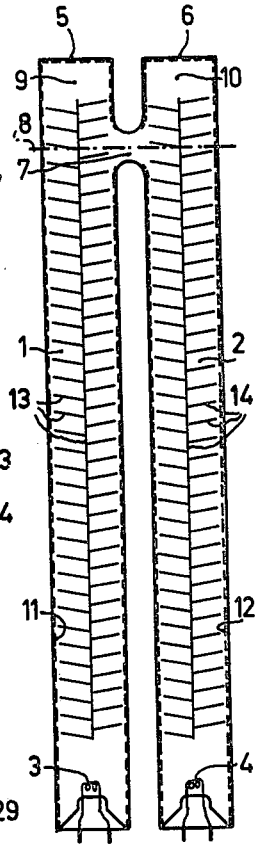

FIG. 1 shows schematically a longitudinal section of a low-pressure mercury vapor discharge lamp comprising two parallel tubular portions which are interconnected by means of a single coupling tube, FIG. 2 shows, also schematically, a low-pressure mercury vapor discharge lamp having four parallel tubular portions which are located in one plane and interconnected in series by means of coupling tubes, and FIG. 3 shows a lamp as shown in FIG. 1, wherein a thinly distributed body of a solid material, having a discharge-permeable structure, is present in the tubular portions of the discharge vessel.

The lamp shown in FIG. 1 comprises a discharge vessel formed by two parallel, coupled glass tubular portions 1 and 2, the inside of the wall of these tubular portions having been provided with luminescent layers 11 and 12, respectively. An electrode 3 is disposed at one end of tube 1 and an electrode 4 is disposed at the corresponding end of tube 2. A coupling tube 7 is provided at a distance from the ends 5 and 6, which are remote from the ends in which the electrodes 3, 4 are disposed. The central axis 8 of the coupling tube 7 is at such a distance (between one and four times the inner diameter of tubes 1, 2) from the ends 5 and 6 that, adjacent these ends 5 and 6, regions 9 and 10 are created in the discharge vessel which have a relatively low temperature during operation. This is due to the fact that the discharge path does not reach these ends, so that the heat radiation originating from the discharge between the electrodes 3 and 4 is relatively small in these portions and the heat transport is relatively great.

In this manner, the mercury vapor pressure remains during operation at the value which is the optimum value for the conversion of applied power into UV-radiation (for lamps comprising a discharge vessel having a diameter of approximately 10 mm this value is near 1.7 Pa). The coupling tube 7 is obtained by fusing together two facing collars each at which is sealed around a respective aperture in tube 1 and in tube 2, respectively.

In a practical embodiment of the last-described lamp, the tubes 1 and 2 were approximately 15 cm long and had an inside diameter of 10 mm. The axis 8 is approximately 15 mm from the end 5 (or 6). The distance between the longitudinal axes of the tubes 1 and 2 is approximately 14 mm. A luminescent material which converts the UV-radiation generated in the discharge into visible light is present on the inside of the wall of each of the tubes 1 and 2. A suitable luminescent material is a mixture of two phosphors, namely green-luminescing, terbium-activated cerium magnesium aluminate and red-luminescing, trivalent europium-activated yttrium oxide. When the lamp is filled with argon at a pressure of 400 Pa its luminous flux is 700 Lumen at an applied power to the lamp of 10 W (operating voltage 60 V, 200 mA).

The discharge vessel of the lamp shown in FIG. 2 has four tubular portions 21, 22, 23 and 24, which are parallel to one another in one plane. These tubes are interconnected by means of coupling tubes 25, 26, and 27. During operation of the lamp a discharge takes place between the electrodes 28 and 29, and moves up through tube 21, through coupling tube 25 to tube 22 and down to electrode 29 via portions 26, 23, 27 and 24. The inside of each tube wall are coated with the same phosphors as for the lamp shown in FIG. 1. The coupling tubes 25, 26 and 27 are formed by fusing collars around apertures in the wall of the tubes 21, 22, 23 and 24.

For a proper operation of this lamp it is not necessary for all coupling tubes (25, 26 and 27) to engage the tubular portions at some distance from their respective ends. To create a cool spot in the discharge vessel it is sufficient for only one coupling tube (for example tube 25) to engage a tubular portion at a given minimum distance from an end. The other coupling tubes 26 and 27 may then be located at the extreme ends of the associated tubular portions.

In a practical embodiment of this lamp the distances between the tubular portions are the same as for a lamp shown in FIG. 1. The tubes are approximately 16.5 cm long. Their inside diameter is approximately 10 mm. At an applied power to the lamp of 20 W (200 mA, 120 V) the luminous flux was approximately 1440 lm.

In the lamp shown in FIG. 3 components corresponding to those of the lamp shown in FIG. 1 are given the same reference numerals. The tubular portions 1 and 2 of the discharge vessel each contain a thinly-distributed body (13 and 14, respectively) consisting of an elongate support extending into the longitudinal direction of the tubular portions, the support having been provided with fibres which are distributed over the space within the discharge vessel and extend in the transverse direction of the support. Such a body is described in Neatherlands Patent Application No. 7701910. In a practical embodiment of this low-pressure mercury vapor discharge lamp (length of the tubular portions approximately 30 cm, inside diameter 18 mm) the luminous flux was 2950 Lumen at an applied power to the lamp of 40 W. (rare gas filling 50% by weight of argon, 50% by weight of neon). The same phosphors as for the lamp shown in FIG. 1 were applied to the inside of the discharge vessel.

What is claimed is:

1. A low-pressure mercury vapor discharge lamp which comprises:

a discharge vessel comprising a plurality of parallel tubular portions, first and second spaced electrodes disposed in said vessel, an ionizable medium in said vessel and means for limiting the pressure in said vessel during operation of said lamp, said means including each tubular portion having an integral collar, said collars of the respective tubular portions being sealed around respective apertures in a wall of the respective tubular portions, said collars of the respective tubular portions being interconnected to form a continuous series passage through said tubular portions, the axis of said collars extending substantially transversely to the parallel axis of the tubular portions, the discharge passing through said collars and at least the major part of each tubular portion during operation of the lamp, said collars of said tubular portions being mutually engaged, at least one of said collars being disposed at a distance from the nearer end of the tubular portion on which it is disposed of one to four times the inner diameter of one of said tubular portions.

2. A low-pressure mercury vapor discharge lamp as described in claim 1 wherein each collar is disposed a distance from the nearer end of the tubular portion on which it is disposed of one to four times the inner diameter of one of said tubular portions.

3. A low-pressure mercury vapor discharge lamp as claimed in claim 1 or 2 wherein the inside diameter of each tubular portion is smaller than 12 mm.

4. A low-pressure mercury vapor discharge lamp as claimed in claim 3 further including a thinly-distributed body of a solid material and having a discharge-permeable structure disposed in at least one of said tubular portions.

* * * * *